US006284442B1

(12) United States Patent
Van Ackere et al.

(10) Patent No.: US 6,284,442 B1
(45) Date of Patent: Sep. 4, 2001

(54) BLACK AND WHITE THERMOGRAPHIC RECORDING MATERIAL WITH IMPROVED DIAGNOSTIC CAPABILITY

(75) Inventors: Guy Michel Van Ackere, Beveren; Geert Defieuw, Bonheiden; Ivan Hoogmartens, Wilrijk; Johan August Loccufier, Zwijnaarde, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/448,392

(22) Filed: Nov. 23, 1999

Related U.S. Application Data

(60) Provisional application No. 60/118,484, filed on Feb. 3, 1999.

(30) Foreign Application Priority Data

Nov. 27, 1998 (EP) ..... 98204007

(51) Int. Cl.[7] ..... G03C 1/498

(52) U.S. Cl. ..... 430/350; 430/517; 430/519; 430/520; 430/521; 430/619

(58) Field of Search ..... 430/619, 350, 430/517, 519, 520, 521

(56) References Cited

U.S. PATENT DOCUMENTS 3,488,195 * 1/1970 Hunter .
3,948,664 * 4/1976 Okuyama et al. .
5,620,839 * 4/1997 Kawamoto et al. ..... 430/523
5,677,121 * 10/1997 Tsuzuki ..... 430/619
5,744,294 4/1998 Dickerson et al. ..... 430/521
5,783,380 7/1998 Smith et al. ..... 430/619

FOREIGN PATENT DOCUMENTS 0919864 6/1999 (EP) .
0889355 7/1999 (EP) .

* cited by examiner

*Primary Examiner*—Thorl Chea
(74) *Attorney, Agent, or Firm*—Baker Botts L.L.P.

(57) ABSTRACT

A black and white monosheet thermographic recording material having a spectrophotometrically determined maximum absorption for visible light between 570 and 650 nm and comprising a support and a thermosensitive element, said thermosensitive element containing a substantially light-insensitive organic silver salt, an organic reducing agent therefor in thermal working relationship therewith and a binder, wherein the substantially light-insensitive black and white monosheet thermographic recording material contains at least two colorants with maximum absorption at a wavelength between 450 nm and 700 nm, none of the at least two colorants is an antihalation dye, and at least one of the at least two colorants is incorporated in the support; and photothermographic and thermographic recording processes therewith.

11 Claims, No Drawings

BLACK AND WHITE THERMOGRAPHIC RECORDING MATERIAL WITH IMPROVED DIAGNOSTIC CAPABILITY

This application claimed the benefit of the provisional application No. 60/118,484 filed Feb. 3, 1999.

FIELD OF THE INVENTION

The present invention relates to thermographic recording materials with improved diagnostic capability.

BACKGROUND OF THE INVENTION

Thermal imaging or thermography is a recording process wherein images are generated by the use of thermal energy. In direct thermal thermography a visible image pattern is formed by image-wise heating of a recording material containing matter that by chemical or physical process changes colour or optical density. Such recording materials become photothermographic upon incorporating a photosensitive agent which after exposure to UV, visible or IR light is capable of catalyzing or participating in a thermographic process bringing about changes in colour or optical density.

Examples of photothermographic materials are the so called "Dry Silver" photothermographic materials of the 3M Company, which are reviewed by D. A. Morgan in "Handbook of Imaging Science", edited by A. R. Diamond, page 43, published by Marcel Dekker in 1991.

EP-A 889 355 discloses a thermographic recording material comprising a substantially colourless support and a thermosensitive element containing a substantially light-insensitive organic silver salt, an organic reducing agent for the substantially light-insensitive organic silver salt in thermal working relationship therewith and a binder, characterized in that a blue pigment or dye having an absorption maximum in the wavelength range from 550 to 700 nm is present in the thermosensitive element and/or any other layer on either side of the support which provides a background for viewing in transmission images produced with the thermographic recording material.

U.S. Pat. No. 5,783,380 discloses a thermally processable imaging element comprising: (1) a support; (2) a thermographic or photothermographic imaging layer on one side of the support; (3) a protective layer overlying the image-forming layer; said protective layer comprising: (A) a film forming binder; (B) a dye dispersed throughout said protective layer in an amount sufficient to impart a pre-selected color thereto; and (C) matte particles the color of the protective layer. No disclosure is made in U.S. Pat. No. 5,783,380 regarding colorant in the support.

EP-A 919 864 discloses a photothermographic element comprising at least one photosensitive layer on a support, wherein the support contains a dye of structure I:

(I)

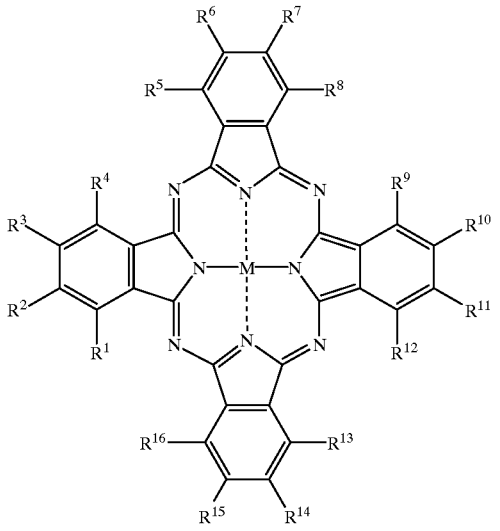

wherein M is a multi-valent metal atom; each of $R_1$, $R_4$, $R_5$, $R_8$, $R_9$, $R_{12}R_{10}$, and $R_{16}$ independently represent a hydrogen atom, or a substituted or unsubstituted, branched or unbranched alkyl group; each of $R_2$, $R_3$, $R_6$, $R_7$, $R_{10}$, $R_{11}$, and $R_{14}$and $R_{15}$ independently represent a hydrogen atom, a halogen atom, a substituted or unsubstituted, branched or unbranched alkyl group, a substituted or unsubstituted aryl group, a substituted or unsubstituted alkoxy group or a substituted or unsubstituted aryloxygroup; or one cr more of the adjacent pairs $R_1$ and $R_2$, $R_2$ and $R_3$, $R_3$ and $R_4$, $R_5$ and $R_6$, $R_6$ and $R_7$, $R_7$ and $R_8$, $R_8$ and $R_9$, $R_9$ and $R_{10}$, $R_{10}$ and $R_{11}$, $R_{11}$ and $R_{12}$, $R_{13}$ and $R_{14}$, $R_{14}$ and $R_{15}$ and $R_{15}$ and $R_{16}$ taken together may represent the atoms necessary to form a substituted or unsubstituted aromatic or heteroaromatic ring; and wherein the support has a peak absorption between about 660 nm and about 800 nm.

Imaging materials for medical applications are in general produced using a support with a particular blue pigment e.g. MACROLEX™ BLUE 3R from BAYER. The colour of such supports can be defined in terms of L*, a* and b* CIELAB-values which are determined by spectrophotometric measurements according to ASTM Norm E179-90 in a R(45/0) geometry with evaluation according to ASTM Norm E308-90. Representative supports used for medical imaging materials have CIELAB-a* values and -b* values given in the table below.

| | a* | b* | Dvis |
|---|---|---|---|
| MEDICAL IMAGING MATERIAL SUPPORT 1 | −7 | −13.82 | 0.172 |
| MEDICAL IMAGING MATERIAL SUPPORT 2 | −7.22 | −13.02 | 0.174 |
| MEDICAL IMAGING MATERIAL SUPPORT 3 | −6.86 | −14.46 | 0.181 |
| MEDICAL IMAGING MATERIAL SUPPORT 4 | −7.92 | −16.62 | 0.195 |

However, the background colour and the colour of an image is a combination of the colour of the support and the colour of the image background and the image of the particular material upon printing. In the case of conventional silver halide images the CIELAB-a* and -b* values of the image are virtually independent of image density, whereas this is not the case for thermographic recording materials based on organic silver salts and reducing agents.

The resolution of medical images, such as X-ray images, is of supreme importance in ensuring reliable diagnosis. It is desirable to improve further the diagnostic reliability of images produced with thermographic recording materials based on organic silver salts and reducing agents using a support with a particular blue pigment, whether produced by thermography or photothermography, thereby ensuring more reliable diagnosis.

OBJECTS OF THE INVENTION

It is therefore an object of the present invention to provide substantially light-insensitive black and white thermographic recording materials whose prints enable more reliable diagnosis.

It is therefore a second object of the present invention to provide black and white photothermographic recording materials whose prints enable more reliable diagnosis.

Further objects and advantages of the invention will become apparent from the description hereinafter.

SUMMARY OF THE INVENTION

It has been surprisingly found that the use of a blue-pigmented support such as used for conventional silver halide X-ray films does not provide an image with optimum diagnostic reliability, but that incorporation of at least two colorants which are not antihalation dyes one of which is in the support and the other is in the support or in any layer making up the thermographic recording material, while ensuring that the blue background necessary for preventing over-exposure of the eyes of the viewer upon viewing in transmission with a view-box and reducing light scattering is maintained, an image with improved diagnostic capability.

The above mentioned objects are realized by a substantially light-insensitive black and white monosheet thermographic recording material having a spectrophotometrically determined maximum absorption for visible light between 570 and 650 nm and comprising a support and a thermosensitive element, said thermosensitive element containing a substantially light-insensitive organic silver salt, an organic reducing agent therefor in thermal working relationship therewith and a binder, wherein the substantially light-insensitive black and white monosheet thermographic recording material contains at least two colorants with maximum absorption at a wavelength between 450 nm and 700 nm; none of the at least two colorants is an antihalation dye; and at least one of the at least two colorants is incorporated in the support.

A black and white monosheet photothermographic recording material is also provided according to the present invention having a spectrophotometrically determined maximum absorption for visible light between 570 and 650 nm and comprising a support and a photo-addressable thermally developable element, said photo-addressable thermally developable element containing a substantially light-insensitive organic silver salt, an organic reducing agent therefor in thermal working relationship therewith, photosensitive silver halide in catalytic association with the substantially light-insensitive organic silver salt and a binder, wherein the black and white monosheet photothermographic recording material contains at least two colorants with maximum absorptions at a wavelength between 450 nm and 700 nm; at least one of the at least two colorants is incorporated in the support; and none of the at least two colorants has a maximum absorption at a wavelength within 30 nm of the wavelength at which maximum spectral sensitivity of the photothermographic recording material is observed.

A thermographic recording process is also provided according to the present invention comprising the steps of: (i) bringing an outermost layer of the above-mentioned thermographic recording material in proximity with a heat source; (ii) applying heat from the heat source imagewise to the recording material while maintaining proximity to the heat source to produce an image; and (iii) removing the recording material from the heat source.

A photothermographic recording process is further provided according to the present invention comprising the steps of: (i) imagewise exposing the above-mentioned photothermographic recording material; (ii) bringing an outermost layer of the photothermographic recording material in proximity with a heat source; (iii) applying heat from the heat source under substantially water-free conditions to the photothermographic recording material while maintaining proximity to the heat source to produce an image; and (iv) removing the photothermographic recording material from the heat source.

DETAILED DESCRIPTION OF THE INVENTION

In a preferred embodiment of the thermographic recording process, according to the present invention, the heat source is a thermal head with a thin film thermal head being particularly preferred.

Definitions

The term colorant means dyes and pigments.

The L*, a* and b* CIELAB-values define the colour of objects and are determined by spectrophotometric measurements according to ASTM Norm E179-90 in a R(45/0) geometry with evaluation according to ASTM Norm E308-90.

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methyl-butyl etc.

The term thermographic recording material includes both thermographic and photothermographic recording materials unless qualified by the expression substantially light-insensitive.

By substantially light-insensitive is meant not intentionally light sensitive.

The term antihalation means having the function of minimizing reflection of incident light from an interface in a material, e.g. from the base into the emulsion of a photographic material, during image-wise exposure. In the case of a material exposed to laser light, this means at the wavelength of the laser light.

The descriptor aqueous in the term aqueous medium for the purposes of the present invention includes mixtures of water-miscible organic solvents such as alcohols e.g. methanol, ethanol, 2-propanol, butanol, iso-amyl alcohol etc.; glycols e.g. ethylene glycol; glycerine; N-methyl pyrrolidone; methoxypropanol; and ketones e.g. 2-propanone and 2-butanone etc. with water in which water constitutes more than 50% by weight of the aqueous medium with 65% by weight of the aqueous medium being preferred and 80% by weight of the aqueous being particularly preferred.

By the term "heat solvent" in this invention is meant a non-hydrolyzable organic material which is in a solid state in the recording layer at temperatures below 50° C., but becomes a plasticizer for the recording layer when thermally heated and/or a liquid solvent for the organic silver salt or the reducing agent.

Heating in a substantially water-free condition as used herein, means heating at a temperature of 80 to 250° C. The term "substantially water-free condition" means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

Colorants

Thermographic recording materials with improved diagnostic capability have been realized according to the present invention by the incorporation of two or more colorants. One of these colorants is incorporated into the support and the other may be variously incorporated into the support or in one or more of the layers of the thermographic recording material e.g. in the thermosensitive element, a protective layer, a layer on the other side of the support to the thermosensitive element, in any other layer which is part of the thermographic recording material or in several layers thereof. In a particularly preferred embodiment of the present invention the second colorant is in the thermosensitive element and/or a layer on the other side of the support to the thermosensitive element.

It is preferred that the colorants used in the thermographic recording materials of the present invention do not react with other ingredients in whichever layer they are present in and do not fade significantly under the exposure in light boxes such as those used for the viewing of diagnostic transparencies.

In a preferred embodiment of the thermographic recording material of the present invention, two colorants are used having maximum absorptions in the ranges 500 to 560 nm and 580 to 700 nm respectively. In another preferred embodiment of the thermographic recording material of the present invention, two colorants are used having maximum absorptions in the ranges 550 to 580 nm and 585 to 700 nm respectively. In yet another preferred embodiment of the thermographic recording material of the present invention, two colorants are used having maximum absorptions in the ranges 580 to 640 nm and 650 to 670 nm respectively.

In a particularly preferred embodiment of the present invention the one of the at least two colorants incorporated in the support is represented by formula (II):

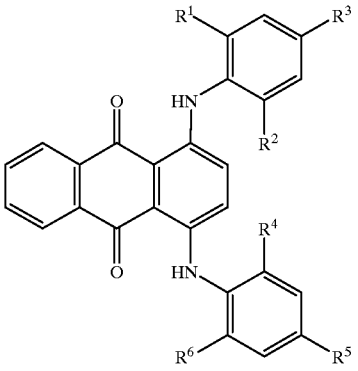

wherein $R^1$, $R^2$, $R^3$, $R^4$, $R^5$ and $R^6$ are independently each hydrogen or an alkyl group.

In a still further preferred embodiment of the thermographic recording material of the present invention, the two or more colorants are selected such that at an image optical density of 1.0, the thermographic recording material has a CIELAB-a* value in the range of −3.75 to −5.75 and a CIELAB-b* value in the range of −6.3 to −8.3 as determined by spectrophotometric measurements according to ASTM Norm E179-90 in a R(45/0) geometry with evaluation according to ASTM Norm E308-90.

The choice of colorants will depend upon the image colour of the thermographic recording material without the addition of such colorants, which will vary with thermographic recording material composition. The colorants may be dyes or pigments or mixtures thereof. In the INVENTION EXAMPLES included herewith, the following colorants are shown to be useful in achieving the required diagnostic improvement while having a maximum absorption for visible light in the range of 570 to 650 nm:

COLORANT 01, MACROLEX™ BLUE 3R from BAYER

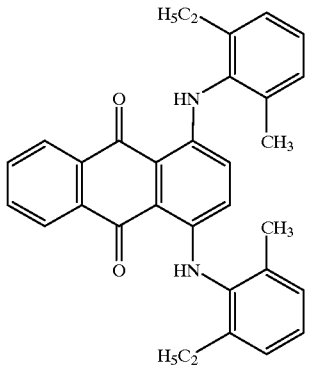

COLORANT 02:

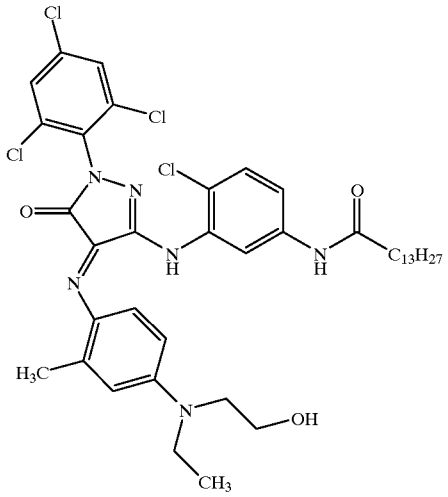

COLORANT 03:
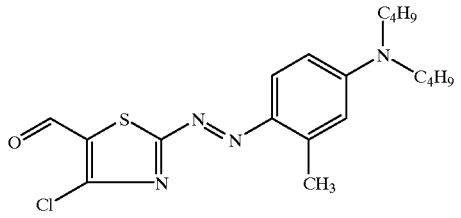
COLORANT 04:
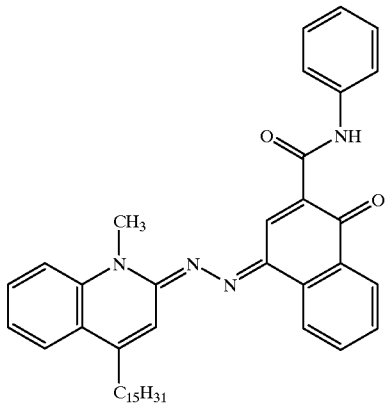
COLORANT 05:
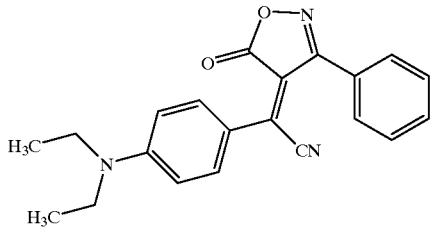
COLORANT 06:
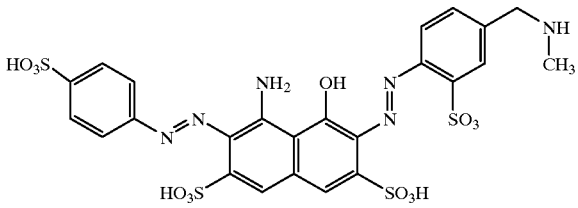
COLORANT 07, HOSTAPERM™ ROSA E02 from HOECHST:
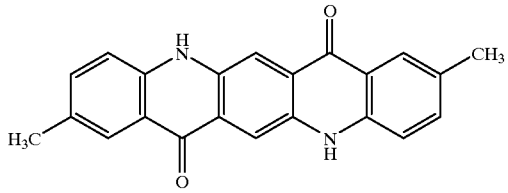
COLORANT 08, PERMANENT CARMINE FBB02 from HOECHST:
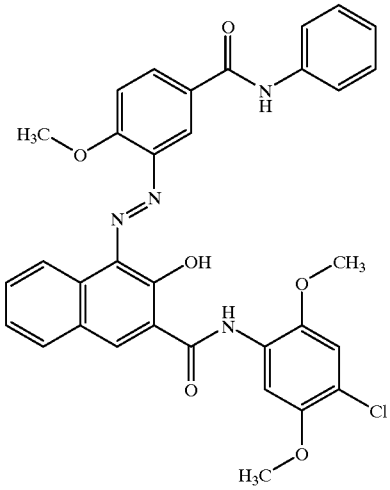
COLORANT 09, LITHOL RUBIN D4595:
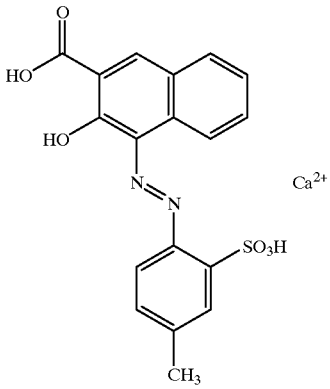

COLORANT 10, MAGENTA CINQUASIA RT355D:

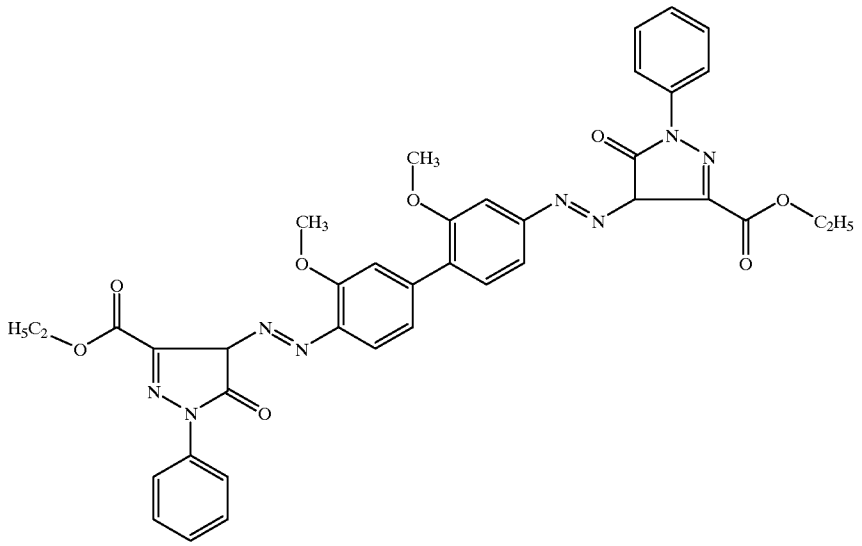

COLORANT 11:

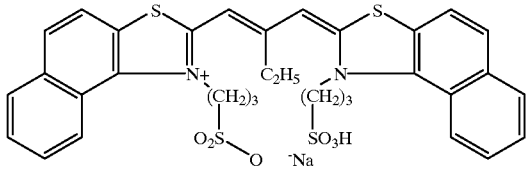

In a preferred embodiment of the photothermographic recording material of the present invention, the support is exclusive of of a dye of structure (I):

(I)

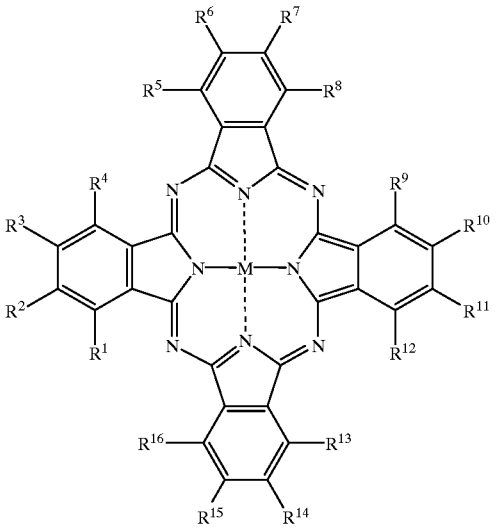

wherein M is a multi-valent metal atom; each of $R_1$, $R_4$, $R_5$, $R_0$, $R_9$, $R_{12}$, $R_{10}$ and $R_{16}$ independently represent a hydrogen atom, or a substituted or unsubstituted, branched or unbranched alkyl group; each of $R_2$, $R_3$, $R_6$, $R_7$, $R_{10}$, $R_{11}$, $R_{14}$ and $R_{15}$ independently represent a hydrogen atom, a halogen atom, a substituted or unsubstituted, branched or unbranched alkyl group, a substituted or unsubstituted aryl group, a substituted or unsubstituted alkoxy group or a substituted or unsubstituted aryloxygroup; or one or more of the adjacent pairs $R_1$ and $R_2$, $R_2$ and $R_3$, $R_3$ and $R_4$, $R_5$ and $R_6$, $R_6$ and $R_7$, $R_7$ and $R_8$and $R_9$, $R_9$ and $R_{10}$, $R_{10}$ and $R_{11}$, $R_{11}$ and $R_{12}$, $R_{13}$ and $R_{14}$, $R_{14}$ and $R_{15}$ and $R_{15}$ and $R_{16}$ taken together may represent the atoms necessary to form a substituted or unsubstituted aromatic or heteroaramatic ring.

Thermosensitive Element

The thermosensitive element, according to the present invention, contains a substantially light-insensitive organic silver salt, a reducing agent therefor in thermal working relationship therewith and a binder. The element may comprise a layer system in which the ingredients may be dispersed in different layers, with the proviso that the substantially light-insensitive organic silver salt is in reactive association with the reducing agent i.e. during the thermal development process the reducing agent must be present in such a way that it is able to diffuse to the particle of substantially light-insensitive organic silver salt so that reduction to silver can occur.

In a preferred embodiment of the present invention the thermosensitive element further contains photosensitive silver halide, making the thermosensitive element photoaddressable and thermally developable and the thermographic recording material photothermographic.

Organic Silver Salt

Preferred organic silver salts for use in the thermographic recording materials of the present invention are substantially light-insensitive silver salts of an organic carboxylic acid. Preferred substantially light-insensitive silver salts of an organic carboxylic acid are silver salts of aliphatic carboxylic acids, known as fatty acids, with at least 12 carbon atoms, e.g. silver laurate, silver palpitate, silver stearate, silver hydroxystearate, silver oleate and silver behenate. Other silver salts of an organic carboxylic acid as described in GB-P 1,439,478, e.g. silver benzoate, may likewise be used to produce a thermally developable silver image. Combinations of different silver salts of organic carboxylic acids, also as mixed crystals, may also be used in the present invention, as disclosed in unpublished European Patent Application EP98201964.8.

Organic silver salts may be dispersed by standard dispersion techniques e.g. using ball mills, bead mills, microfluidizers, ultrasonic apparatuses, rotor stator mixers etc. have been found to be useful in this regard.

Reducing Agents

Suitable organic reducing agents for the reduction of mixed crystals of two or more organic silver salts are organic compounds containing at least one active hydrogen atom linked to O N or C, such as is the case with, aromatic di- and tri-hydroxy compounds; aminophenols; METOL™; p-phenylene-diamines; alkoxynaphthols, e.g. 4-methoxy-l-naphthol described in U.S. Pat. No 3,094,41; pyrazolidin-3-one type reducing agents, e.g. PHENIDONE™; pyrazolin-5-ones; indan-1,3-dione derivatives; hydroxytetrone acids; hydroxytetronimides; hydroxylamine derivatives such as for example described in U.S. Pat No. 4,082,901; hydrazine derivatives; and reductones e.g. ascorbic acid; see also U.S. Pat. Nos. 3,074,809, 3,080,254, 3,094,417 and 3,887,378.

1,2-dihydroxybenzene derivatives, such as catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters are preferred, with those described in EP-B 692 733 and EP-A 903 625 being particularly preferred. In another preferred embodiment of the present invention the thermosensitive element contains a 3,4-dihydroxyphenyl compound in which a benzene ring substituted with any group in the 1-position is further substituted with hydroxy-groups in the 3- and 4-positions, the 3,4-dihydroxyphenyl compound being preferably selected from the group consisting of gallic acid derivatives, gallates, ethyl 3,4-dihydroxybenzoate, butyl 3,4-dihydroxybenzoate and 3,4-dihydroxybenzonitrile.

Combinations of reducing agents may also be used that on heating become reactive partners in the reduction of the substantially light-insensitive organic silver salt, or mixtures or mixed crystals of two or more organic silver salts. For example, combinations of reducing agents with sulfonamidophenols are described in the periodical Research Disclosure, February 1979, item 17842, in U.S. Pat. Nos. 4,360,581 and 4,782,004, and in EP-A 423 891 and combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. Nos. 5,545,505, 5.545.507 and 5,558,983; acrylonitrile compounds as disclosed in U.S. Pat. Nos. 5,545,515 and 5,635,339; and 2-substituted malonodialdehyde compounds as disclosed in U.S. Pat. No. 5,654,130. Organic reducing metal salts, e.g. stannous stearate, have also been used in such reducing agent combinations, as disclosed in U.S. Pat. Nos. 3,460,946 and 3,547,648, as have sterically hindered phenols and bisphenols, as described in U.S. Pat. Nos. 4,001,026 and 3,547,648 respectively.

Binder of the Thermosensitive Element

The film-forming binder of the thermosensitive element may be all kinds of natural, modified natural or synthetic resins or mixtures of such resins, in which the substantially light-insensitive organic silver salt or mixed crystals thereof can be dispersed homogeneously either in aqueous or solvent media: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

Suitable water-soluble film-forming binders for use in thermographic recording materials according to the present invention are: polyvinyl alcohol, polyacrylamide, polymethacrylamide, polyacrylic acid, polymethacrylic acid, polyvinylpyrrolidone, polyethyleneglycol, proteinaceous binders such as gelatin, modified gelatins such as phthaloyl gelatin, polysaccharides, such as starch, gum arabic and dextran and water-soluble cellulose derivatives. A preferred water-soluble binder for use in the thermographic recording materials of the present invention is gelatin.

Preferred water-dispersible binders for use according to the present invention are water-dispersible film-forming polymers with covalently bonded ionic groups selected from the group consisting of sulfonate, sulfinate, carboxylate, phosphate, quaternary ammonium, tertiary sulfonium and quaternary phosphonium groups. Further preferred water-dispersible binders for use according to the present invention are water-dispersible film-forming polymers with covalently bonded moieties with one or more acid groups. Water-dispersible binders with crosslinkable groups, e.g. epoxy groups, aceto-acetoxy groups and crosslinkable double bonds are also preferred. Particularly preferred water-dispersible binders for use in the thermographic recording materials of the present invention are polymer latexes.

As the binder to organic silver salt weight ratio decreases the gradation of the image increasing. Binder to organic silver salt weight ratios of 0.2 to 6 are preferred with weight ratios between 0.5 and 3 being particularly preferred.

The above mentioned binders or mixtures thereof may be used in conjunction with waxes or "heat solvents" to improve the reaction speed of the organic silver salt reduction at elevated temperatures.

Toning Agent

In order to obtain a neutral black image tone in the higher densities and neutral grey in the lower densities, the thermosensitive element preferably further contains a so-called toning agent known from thermography or photothermography.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type as disclosed in GB 1,439,478, U.S. Pat. Nos. 3,951,660 and 5,599,647.

Stabilizers and Antifoggants

In order to obtain improved shelf-life and reduced fogging, stabilizers and antifoggants may be incorporated into the thermographic recording materials of the present invention.

Polycarboxylic Acids and Anhydrides Thereof

According to the recording material of the present invention the thermosensitive element preferably further contains at least one polycarboxylic acid and/or anhydride thereof in a molar percentage of at least 10 with respect to all the organic silver salt(s) present and in thermal working relationship therewith, with a molar percentage of at least 15 with respect to all the organic silver salt(s) being particularly preferred. The polycarboxylic acid may be aliphatic (saturated as well as unsaturated aliphatic and also cycloaliphatic) or an aromatic polycarboxylic acid. These acids may be substituted e.g. with alkyl, hydroxyl, nitro or halogen. They may be used in anhydride form or partially esterified on the condition that at least two free carboxylic acids remain or are available in the heat recording step.

Particularly suitable are saturated aliphatic dicarboxylic acids containing at least 4 carbon atoms, e.g.: succinic acid, glutaric acid, adipic acid, pimelic acid, suberic acid, azelaic acid, sebacic acid, nonane-dicarboxylic acid, decane-dicarboxylic acid, undecane-dicarboxylic acid.

Suitable unsaturated dicarboxylic acids are : maleic acid, citraconic acid, itaconic acid and aconitic acid. Suitable polycarboxylic acids are citric acid and derivatives thereof, acetonedicarboxylic acid, iso-citric acid and a-ketoglutaric acid.

Preferred aromatic polycarboxylic acids are ortho-phthalic acid and 3-nitro-phthalic acid, tetrachlorophthalic acid, mellitic acid, pyromellitic acid and trimellitic acid and the anhydrides thereof.

Surfactants and Dispersion Agents

Surfactants and dispersants aid the dispersion of ingredients or reactants which are insoluble in the particular dispersion medium. The thermographic recording materials of the present invention may contain one or more surfactants, which may be anionic, non-ionic or cationic surfactants and/or one or more dispersants.

Other Additives

The recording material may contain in addition to the ingredients mentioned above other additives such as antistatic agents, e.g. non-ionic antistatic agents including a fluorocarbon group as e.g. in $F_3C(CF_2)_6CONH(CH_2CH_2O)$—H, silicone oil, e.g. BAYSILON™ MA (from BAYER AG, GERMANY).

Photosensitive Silver Halide

The photosensitive silver halide used in the present invention may be employed in a range of 0.1 to 100 mol percent; preferably, from 0.2 to 80 mol percent; particularly preferably from 0.3 to 50 mol percent; especially preferably from 0.5 to 35 mol %; and especially from 1 to 12 mol % of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

Spectral Sensitization

The photosensitive silver halide in the photo-addressable thermally developable element of the photothermographic recording material, according to the present invention, may be spectrally sensitized with a spectral sensitizer, optionally together with a supersensitizer, preferably to infra-red wavelengths. Various known dyes are suitable spectral sensitizers including cyanine, merocyanine, styryl, hemicyanine, oxonol, hemioxonol and xanthene dyes optionally. Preferred cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Preferred merocyanine dyes include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. Of the above described cyanine and merocyanine dyes, those having imino groups or carboxyl groups are particularly preferred.

Support

The support for the thermosensitive element according to the present invention may be transparent or translucent and is a thin flexible carrier made of transparent resin film, e.g. made of a cellulose ester, cellulose triacetate, polypropylene, polycarbonate or polyester, e.g. polyethylene terephthalate.

The support may be in sheet, ribbon or web form and subbed if need be to improve the adherence to the thereon coated thermosensitive element. One or more backing layers may be provided to control physical properties such as curl and static.

Protective Layer

According to a preferred embodiment of the recording material, according to the present invention, the thermosensitive element is provided with a protective layer to avoid local deformation of the thermosensitive element and to improve resistance against abrasion. It is preferred that no colorant is present in the protective layer and that any matte particles therein also do not contain colorant.

The protective layer preferably comprises a binder, which may be solvent-soluble, solvent-dispersible, water-soluble or water-dispersible. Among the solvent-soluble binders polycarbonates as described in EP-A 614 769 are particularly preferred. However, water-soluble or water-dispersible binders are preferred for the protective layer, as coating can be performed from an aqueous composition and mixing of the protective layer with the immediately adjacent layer can be avoided by using a solvent-soluble or solvent-dispersible binder in the immediately adjacent layer.

According to an embodiment of the present invention the protective layer of the recording material may comprise a water-soluble binder, a water-dispersible binder or a mixture of a water-soluble and a water-soluble binder.

The protective layer according to the present invention may be crosslinked. Crosslinking can be achieved by using crosslinking agents such as described in WO 95/12495.

Solid or liquid lubricants or combinations thereof are suitable for improving the slip characteristics of the thermographic recording materials according to the present invention, with the thermomeltable particles disclosed in WO 94/11199 being preferred.

The protective layer of the thermographic recording material according to the present invention may comprise a matting agent. Suitable matting agents are described in WO 94/11198 and optionally protrude from the protective layer.

Coating

The coating of any layer of the recording material of the present invention may proceed by any known coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Thermographic Processing

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, with a substantially light-insensitive thermographic material preferably containing an infra-red absorbing compound i.e. so-called heat mode, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. Such thermal printing heads may be used in contact or close proximity with the recording material. The operating temperature of common thermal printheads is in the range of 300 to 400° C. and the heating time per picture element (pixel) may be less than 0.1 ms, the pressure contact of the thermal printhead with the recording material being e.g. 200–500 g/cm$^2$ to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. The image-wise heating can be carried out such that heating elements not required to produce an image pixel generate an amount of heat ($H_C$) in accordance with the following formula: $0.5\ H_D<H_C<H_D$ wherein $H_D$ represents the minimum amount of heat required to cause visible image formation in the recording material.

EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound, using e.g. an ultrasonic pixel printer as described e.g. in U.S. Pat. No. 4,908,631.

Photothermographic Printing

Photothermographic recording materials, according to the present invention, may be exposed with radiation of wavelength between an X-ray wavelength and a 5 microns wavelength with the image either being obtained by pixel-wise exposure with a finely focused light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermo-graphic recording materials, according to the present invention, any sort of heat source can be used that enables the recording materials to be uniformly heated to the development temperature in a time acceptable for the application concerned e.g. contact heating, radiative heating, microwave heating etc.

Industrial Application

The thermographic recording materials of the present invention are for use in the production of transparencies for medical diagnostic applications operating with a light box.

The invention is illustrated hereinafter by way of invention examples and comparative examples. The percentages and ratios given in these examples are by weight unless otherwise indicated. The ingredients used in the invention and comparative examples, other than those mentioned above, are:

for the thermosensitive element:

organic silver salts:

AgB=silver behenate;

the binders:

B79=BUTVAR™ B79 a polyvinyl butyral from MONSANTO;

GEL01=type 7598, a calcium-free gelatin from AGFA-GEVAERT GELATINEFABRIEK vorm. KOEPFF & SÖHNE;

GEL02=type 16096, gelatin from AGFA-GEVAERT GELATINEFABRIEK vorm. KOEPFF & SÖHNE;

GEL03=type 17881, a calcium-free gelatin from AGFA-GEVAERT GELATINEFABRIEK vorm. KOEPFF & SÖHNE;

LATEX 01=a latex terpolymer consisting of 43.25% butyl acrylate, 54.25% styrene; and 2.5% potassium salt of N-[sulfobenzamido)-oxo-decyl]methacrylamide;

the reducing agent:

R01=ethyl 3,4-dihydroxybenzoate;

R02=3,4-dihydroxybenzonitrile;

the toning agents:

T01=7-(ethylcarbonato)-benzo[e][1,3]oxazine-2,4-dione;

T02=benzo[e][1,3]oxazine-2,4-dione;

T03=phthalazinone;

the surfactants:

Surfactant Nr. 1=HOSTAPALT™ B, supplied as a 50% concentrate of a sodium trisalkylphenylpolyethyleneglycol (EO 7–8)sulphate by HOECHST;

Surfactant Nr. 2=ammonium alkyl-phenylsulfonate produced from MARLON™ A-365, of a sodium alkylphenyl-sulfonate from HÜLS;

Surfactant Nr. 3=hexadecyl-dimethylammonio-acetic acid;

the stabilizers:

S01=adipic acid,

S02=tetrachlorophthalic acid anhydride;

S03=benzotriazole; and the silicone oil:

BAYSILON™ MA, a polydimethylsiloxane from BAYER;

and in the protective layer:

POLYVIOL™ WX48 20, a polyvinylalcohol from WACKER CHEMIE;

RILANIT™ GMS, a glycerine monotallow acid ester, from HENKEL AG

MICROACE TALC P3, an Indian talc from NIPPON TALC:

SERVOXYL™ VPAZ 100=a mixture of monolauryl and dilauryl phosphate, from SERVO DELDEN B.V.;

SERVOXYL™ VPDZ 3/100=a mono[isotridecyl polyglycolether (3 EO)] phosphate, from SERVO DELDEN B.V.;

LEVASIL™ VP AC 4055, a 15% aqueous dispersion of colloidal silica with acid groups predominantly neutralized with sodium ions and a specific surface are of 500 $m^2/g$, from BAYER AG has been converted into the ammonium salt;

RESIMENE™ AQ7550, a high solids, partially methylated melamine formaldehyde crosslinking resin as a 78% aqueous solution from MONSANTO.

COMPARATIVE EXAMPLE 1 and INVENTION EXAMPLES 1 to 13

A subbed 175 $\mu$m thick polyethylene terephthalate support pigmented with COLORANT 1 to give the CIELAB-L*, a* and -b* values of 83.61, −7.92 and −16.62 respectively and a visible density of 0.195 was doctor blade-coated with a composition containing 2-butanone as solvent/dispersing medium so as to obtain thereon, after drying, the thermosensitive elements of COMPARATIVE EXAMPLE 1 not containing a colorant in the thermosensitive element and the thermosensitive elements of INVENTION EXAMPLES 1 to 13 with the COLORANT specified in the concentration specified and with the compositions summarized in table 1 below:

TABLE 1

| | COLORANT | | AgB | B79 | Oil | T01 | T02 | R01 | S01 | S02 | S03 |
|---|---|---|---|---|---|---|---|---|---|---|---|
| | number | mg/m³ | g/m³ | g/m³ | g/m³ | g/m³ | g/m³ | g/m³ | g/m² | g/m³ | g/m² |
| Comparative example nr. | | | | | | | | | | | |
| 1 | — | — | 4.105 | 12.32 | 0.036 | 0.224 | 0.115 | 0.827 | 0.293 | 0.130 | 0.108 |
| Invention example nr. | | | | | | | | | | | |
| 1 | 02 | 2.09 | 4.105 | 12.32 | 0.036 | 0.224 | 0.115 | 0.827 | 0.293 | 0.130 | 0.108 |
| 2 | 07 | 2.09 | 4.105 | 12.32 | 0.036 | 0.224 | 0.115 | 0.827 | 0.293 | 0.130 | 0.108 |
| 3 | 07 | 8.4 | 4.105 | 12.32 | 0.036 | 0.224 | 0.115 | 0.827 | 0.293 | 0.130 | 0.108 |
| 4 | 07 | 12.6 | 4.105 | 12.32 | 0.036 | 0.224 | 0.115 | 0.827 | 0.293 | 0.130 | 0.108 |
| 5 | 08 | 2.09 | 4.105 | 12.32 | 0.036 | 0.224 | 0.115 | 0.827 | 0.293 | 0.130 | 0.108 |
| 6 | 08 | 4.2 | 4.105 | 12.32 | 0.036 | 0.224 | 0.115 | 0.827 | 0.293 | 0.130 | 0.108 |
| 7 | 08 | 8.4 | 4.105 | 12.32 | 0.036 | 0.224 | 0.115 | 0.827 | 0.293 | 0.130 | 0.108 |
| 8 | 09 | 4.2 | 4.105 | 12.32 | 0.036 | 0.224 | 0.115 | 0.827 | 0.293 | 0.130 | 0.108 |
| 9 | 09 | 8.4 | 4.105 | 12.32 | 0.036 | 0.224 | 0.115 | 0.827 | 0.293 | 0.130 | 0.108 |
| 10 | 09 | 12.6 | 4.105 | 12.32 | 0.036 | 0.224 | 0.115 | 0.827 | 0.293 | 0.130 | 0.108 |
| 11 | 10 | 8.4 | 4.105 | 12.32 | 0.036 | 0.224 | 0.115 | 0.827 | 0.293 | 0.130 | 0.108 |
| 12 | 10 | 12.6 | 4.105 | 12.32 | 0.036 | 0.224 | 0.115 | 0.827 | 0.293 | 0.130 | 0.108 |
| 13 | 10 | 16.8 | 4.105 | 12.32 | 0.036 | 0.224 | 0.115 | 0.827 | 0.293 | 0.130 | 0.108 |

Thermographic Printing

During the thermographic printing of the substantially light-insensitive thermographic recording materials of INVENTION EXAMPLES 1 to 13, the print head was separated from the imaging layer by a thin intermediate material contacted with a slipping layer of a separable 5 mm thick polyethylene terephthalate ribbon coated successively with a subbing layer, heat-resistant layer and the slipping layer (anti-friction layer) giving a ribbon with a total thickness of 6 mm.

The printer was equipped with a thin film thermal head with a resolution of 300 dpi and was operated with a line time of 19 ms (the line time being the time needed for printing one line). During this line time the print head received constant power. The average printing power, being the total amount of electrical input energy during one line time divided by the line time and by the surface area of the heat-generating resistors was 1.6 mJ/dot being sufficient to obtain maximum optical density in each of the substantially light-insensitive thermographic recording materials of INVENTION EXAMPLES 1 to 13 and COMPARATIVE EXAMPLE 1.

The images exhibits maximum densities of about 3.0 and minimum densities of about 0.26 measured through a visible filter with a MACBETH™ TR924 densitometer in the grey scale step corresponding to data levels of 64 and 0 respectively.

Diagnostic Acceptance

The diagnostic acceptance of prints of COMPARATIVE EXAMPLE 1 was evaluated in comparison with a state of the art wet printing system SCOPIX™ LR3300 (printer) and SCOPIX™ LT2B (film) from AGFA-GEVAERT N.V. at several hospitals in Belgium. A statistical robust pair analysis of the judgement on 7 parameters was carried out on the hard copies of COMPARATIVE EXAMPLE 1 and the SCOPIX films. Validation by 4 radiologists for different modalities and 25 studies per modality. The diagnostic confidence was comparable for all studies. The radiologists perceived images using the SCOPIX™ LT2B film to be crisper than images using the thermographic recording materials of the type of COMPARATIVE EXAMPLE 1, although there was no difference in measured CTF-sharpness. This indicates the benefit of the blue tone of the SCOPIX film for an optical density of 1.0 with CIELAB-a* and -b* values of −4.7 and −8.6 respectively as compared with the CIELAB-L*, -a* and -b* values for the support of 85.64, −7.00 and −13.82 respectively.

Image Evaluation

The image tone of fresh prints made with the substantially light-insensitive thermographic recording materials of INVENTION EXAMPLES 1 to 13 was assessed on the basis of the L*, a* and b* CIELAB-values. The a* and b* CIELAB-values of fresh prints of the substantially light-insensitive thermographic recording materials of INVENTION EXAMPLES 1 to 13 at optical densities, D, of 1.0 are summarized in table 2.

Light Stability Tests

The light stability tests were carried out on substantially light-insensitive thermographic recording materials of INVENTION EXAMPLES 1 to 13 using a SUNTEST CPS apparatus from HERAEUS. The thermographic recording materials were exposed through a glass filter which removes infrared light with wavelengths above 700 nm and ultraviolet light with wavelengths below 310 nm to a light flux from a low pressure xenon lamp NXE 1500 of approximately 110 kLux under ambient conditions during the 16 h suntest and at a high relative humidity during 48 h high humidity test. The results are given in table 2.

TABLE 2

| | COLORANT | | | CIELAB-values at D = 1.0 | | light stability | |
|---|---|---|---|---|---|---|---|
| | number | $\lambda_{max}$ [nm] | mg/m$^2$ | a* | b* | 16 h in sun | 48 h exposure at high humidity |
| Comparative example nr | | | | | | | |
| 1 | — | — | — | −4.7 | −6.17 | — | — |
| Invention example nr | | | | | | | |
| 1 | 02 | 542 | 2.09 | −3.04 | −7.1 | moderate | bad |
| 2 | 07 | 538 | 2.09 | −4.4 | −7.7 | good | good |
| 3 | 07 | 538 | 8.4 | −3.9 | −6.9 | good | good |
| 4 | 07 | 538 | 12.6 | −3.2 | −7.7 | good | good |
| 5 | 08 | — | 2.09 | −4.4 | −6.7 | good | good |
| 6 | 08 | — | 4.2 | −4.2 | −7 | good | good |
| 7 | 08 | — | 8.4 | −3.3 | −7.5 | good | good |
| 8 | 09 | — | 4.2 | −4.4 | −6.3 | good | good |
| 9 | 09 | — | 8.4 | −4.2 | −6.4 | good | good |
| 10 | 09 | — | 12.6 | −3.9 | −6.9 | good | good |
| 11 | 10 | — | 8.4 | −4.44 | −6.21 | good | good |
| 12 | 10 | — | 12.6 | −4.02 | −6.29 | good | good |
| 13 | 10 | — | 16.8 | −3.76 | −6.96 | good | good |

Colour neutrality on the basis of CIELAB-values corresponds to a* and b* values of zero, with a negative a*-value indicating a greenish image-tone becoming greener as a* becomes more negative, a positive a*-value indicating a reddish image-tone becoming redder as a* becomes more positive, a negative b*-value indicating an increasingly bluer image-tone as b* becomes more negative and a positive b*-value indicating a yellowish image-tone becoming more yellow as b* becomes more positive.

In terms of the visual perception of an image as a whole, the image tone of elements of the image with a density of 1.0 have a stronger effect than the image tone of elements with lower or higher optical. Furthermore, the image tone generally becomes more neutral as the density increases. The CIELAB co-ordinates for an optical density of 1.0 are therefore critical in assessing the perceived image tone of an image.

With all of the COLORANTS 02, 07, 08, 09 and 10 in the thermosensitive element in combination with a support containing COLORANT 01, similar CIELAB-a* and -b* values were obtained to that of the SCOPIX LT2B film and hence improved diagnostic capability in the coverage range of 2.09 to 16.8 mg/m$^2$. Only substantially light-insensitive thermographic recording materials containing COLO- RANTS 07, 08, 09 and 10 exhibited resistance to fading under 16 h of simulated sunlight and 48 h exposure at high humidities. The resultant CIELAB-a* and -b* values are a result of the intrinsic properties of the substantially light-insensitive thermographic recording material combined with the colorant properties of the blue pigment in the support having a maximum absorption in the range of 590 to 640 nm in combination with a second colorant having a maximum absorption in the binder used of 500 to 560 nm.

INVENTION EXAMPLE 14 and COMPARATIVE EXAMPLE 2

IMATION DRYVIEW™ Laser Imaging Film, a photothermographic material based on organic silver salts and a reducing agent therefor and having a blue-pigmented support having CIELAB-L*, -a* and b* values of 85.48, −7.22 and −13.02 respectively and a Dvis of 0.174, with I.D. No. 98-0439-9800-8 and Emulsion No. 021635-018-A-005 for use before October 1998, was printed with a DRYVIEW™ 8700 Laser Imager under standard DRYVIEW™ processing conditions to produce the thermographic recording material of COMPARATIVE EXAMPLE 2. A gelatine layer containing COLORANT 11 was applied to the side of the DRYVIEW™ photothermographic material opposite to that of the photo-addressable thermally developable element (thermosensitive element with photosensitive silver halide) at a COLORANT 11 coverage of 10 mg/m$^2$ to produce the phothermographic recording material of INVENTION EXAMPLE 14. The CIELAB-a* and -b* values obtained with this photothermographic recording material are given in table 3.

TABLE 3

| Comparative | SECOND COLORANT | | CIELAB-values at D = 1.0 | |
|---|---|---|---|---|
| example nr | number | mg/m$^2$ | a* | b* |
| 2 | — | — | −1.0 | −7.03 |
| Invention example nr. 14 | 11 | 10 | −3.95 | −8.9 |

These results demonstrate that addition of COLORANT 11 to a print produced with the photothermographic recording material of COMPARATIVE EXAMPLE 2 with a blue-pigmented support to a coverage of 10 mg/m$^2$ produces a photothermographic recording material with CIELAB-a* and -b* values for an image density of 1.0 comparable with those of the SCOPIX LT2B film, thereby enhancing the diagnostic capability of the photothermographic recording material of COMPARATIVE EXAMPLE 2. The resultant CIELAB-a* and -b* values are a result of the intrinsic properties of the photothermographic recording material combined with the colorant properties of the blue pigment in the support having a maximum absorption in the range of 580 to 700 nm in combination with a second colorant having a maximum absorption in gelatin of 657 nm.

COMPARATIVE EXAMPLE 3 and INVENTION EXAMPLES 15 to 18

A subbed 175 μm thick polyethylene terephthalate support pigmented with COLORANT 01 to give the CIELAB-L*, a* and -b* values of 84.91, −6.86 and −14.46 respectively and a visible density of 0.181 was doctor blade-coated with an aqueous dispersion so as to obtain thereon, after drying, the thermosensitive elements of COMPARATIVE EXAMPLE 3 and INVENTION EXAMPLES 15 to 18 with the composition given below:

| | |
|---|---|
| AgB | 4.92 g/m$^2$ |
| GEL03 | 3.25 g/m$^2$ |
| LATEX01 | 0.74 g/m$^2$ |
| R02 | 1.037 g/m$^2$ |
| T01 | 0.139 g/m$^2$ |
| T03 | 0.35 g/m$^2$ |
| Surfactant Nr. 2 | 0.315 g/m$^2$ |
| Surfactant Nr. 3 | 0.13 g/m$^2$ |
| formaldehyde | 0.2 g/m$^2$ |

This thermosensitive element was then overcoated with a protective layer with the following composition:

| | |
|---|---|
| POLYVIOL ™ WX48 20 | 2.258 g/m$^2$ |
| MICROACE TALC P3 | 0.039 g/m$^2$ |
| SERVOXYL VPDZ 3/100 | 0.075 g/m$^2$ |
| SERVOXYL VPAZ 100 | 0.070 g/m$^2$ |
| SYLOID 72 | 0.080 g/m$^2$ |
| RILANIT ™ GMS | 0.119 g/m$^2$ |
| LEVASIL ™ VP AC 4055 | 0.750 g/m$^2$ |
| RESIMENE ™ AQ7550 | 0.351 g/m$^2$ |
| p-toluene sulfonic acid | 0.035 g/m$^2$ |
| Surfactant Nr. 1 | 0.048 g/m$^2$ |

4 sheets of the resulting substantially light-insensitive thermographic recording materials were printed as described for the substantially light-insensitive thermographic recording materials of INVENTION EXAMPLES 1 to 13 and COMPARATIVE EXAMPLE 2 except that the protective layer was in direct contact with the thermal head.

Finally layers containing different COLORANTS were applied to the side of the resulting substantially light-insensitive thermographic recording material opposite to that of the thermosensitive element, see table 4 for the COLORANT, coverage and binder used to produce the thermographic recording materials of INVENTION EXAMPLES 15 to 18.

TABLE 4

| Comparative | COLORANT | | GEL01 | B79 |
|---|---|---|---|---|
| example nr. | number | mg/m$^2$ | g/m$^2$ | g/m$^3$ |
| 3 | — | — | — | — |
| Invention example nr. | | | | |
| 15 | 06 | 60 | 1.76 | — |
| 16 | 03 | 5 | — | 1.0 |
| 17 | 04 | 5 | — | 1.0 |
| 18 | 05 | 5 | — | 1.0 |

The CIELAB-a* and -b* values obtained with these thermographic recording materials are given in table 5.

TABLE 5

| Comparative | COLORANT | | CIELAB-values at D = 1.0 | |
|---|---|---|---|---|
| example nr | number | mg/m$^2$ | a* | b* |
| 3 | — | — | −5.14 | −1.54 |
| Invention example nr | | | | |
| 15 | 06 | 60 | −4.59 | −4.0 |
| 16 | 03 | 5 | −3.53 | −7.21 |

TABLE 5-continued

| Comparative | COLORANT | | CIELAB-values at D = 1.0 | |
|---|---|---|---|---|
| example nr | number | mg/m$^2$ | a* | b* |
| 17 | 04 | 5 | −3.06 | −5.09 |
| 18 | 05 | 5 | −3.27 | −6.83 |

These results demonstrate that addition of COLORANTS 3, 4, 5 and 6 to a print produced with the substantially light-insensitive thermographic recording material of COMPARATIVE EXAMPLE 3 with a blue-pigmented support to coating weights of 5 to 60 mg/m$^2$, depending upon the choice of second COLORANT, produces a substantially light-insensitive thermographic recording material with CIELAB-a* and -b* values for an image density of 1.0 comparable with those of the SCOPIX LT2B film, thereby enhancing the diagnostic capability of the thermographic recording material of COMPARATIVE EXAMPLE 3. The resultant CIELAB-a* and -b* values are a result of the intrinsic properties of the substantially light-insensitive thermographic recording material combined with the colorant properties of the blue pigment in the support having a maximum absorption in the range of 585 to 640 nm in combination with a second colorant having a maximum absorption in the binder used of 550 to 580 nm.

Having described in detail preferred embodiments of the current invention, it will now be apparent to those skilled in the art that numerous modifications can be made therein without departing from the scope of the invention as defined in the following claims.

What is claimed is:

1. A substantially light-insensitive black and white monosheet thermographic recording material having a spectrophotometrically determined maximum absorption for visible light between 570 and 650 nm and comprising a support and a thermosensitive element, said thermosensitive element containing a substantially light-insensitive organic silver salt, an organic reducing agent therefor in thermal working relationship therewith and a binder, wherein said substantially light-insensitive black and white monosheet thermographic recording material contains at least two colorants with maximum absorption at a wavelength between 450 nm and 700 nm; none of said at least two colorants is an antihalation dye; and at least one of said at least two colorants is incorporated in said support, and the other of said at least two colorants is incorporated in said thermosensitive element, in a layer on the other side of said support to said thermosensitive layer or a combination thereof.

2. Thermographic recording material according to claim 1, wherein said one of said at least two colorants incorporated into said support is represented by formula (II):

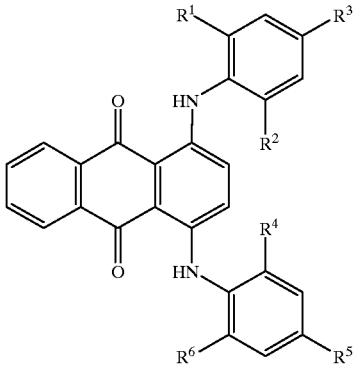

wherein $R^1$, $R^2$, $R^3$, $R^4$, $R^5$ and $R^6$ are independently each hydrogen or an alkyl group.

3. Thermographic recording material according to claim 1, wherein said reducing agent is a 1,2-dihydroxy-benzene derivative.

4. Thermographic recording material according to claim 1, wherein said reducing agent is a 3,4-dihydroxyphenyl compound.

5. Thermographic recording material according to claim 1, wherein said thermosensitive element is provided with a protective layer.

6. A thermographic recording process comprising the steps of: (i) bringing an outermost layer of a substantially light-insensitive black and white monosheet thermographic recording material having a spectrophotometrically determined maximum absorption for visible light between 570 and 650 nm and comprising a support and a thermosensitive element into proximity with a heat source, said thermosensitive element containing a substantially light-insensitive organic silver salt, an organic reducing agent therefor in thermal working relationship therewith and a binder; (ii) applying heat from said heat source imagewise to said thermographic recording material while maintaining proximity to said heat source to produce an image; and (iii) removing said thermographic recording material from said heat source, wherein said substantially light-insensitive black and white monosheet thermographic recording material contains at least two colorants with maximum absorption at a wavelength between 450 nm and 700 nm; none of said at least two colorants is an antihilation dye; and at least one of said at least two colorants is incorporated in said support, and the other of said at least two colorants is incorporated in said thermosensitive element, in a layer on the other side of said support to said thermosensitive layer or a combination thereof.

7. A black and white monosheet photothermographic recording material having a spectrophotometrically determined maximum absorption for visible light between 570 and 650 nm and comprising a support and a photoaddressable thermally developable element, said photoaddressable thermally developable element containing a substantially light-insensitive organic silver salt, an organic reducing agent therefor in thermal working relationship therewith, photosensitive silver halide in catalytic association with said substantially light-insensitive organic silver salt and a binder, wherein said black and white monosheet photothermographic recording material contains at least two colorants with maximum absorptions at a wavelength between 450 nm and 700 nm; at least one of said at least two colorants is incorporated in said support, and the other of said at least two colorants is incorporated in said thermosensitive element, in a layer on the other side of said support to said thermosensitive layer or a combination thereof; and none of said at least two colorants has a maximum absorption at a wavelength within 30 nm of the wavelength at which maximum spectral sensitivity of said photothermographic recording material is observed.

8. Photothermographic recording material according to claim 7, wherein said support is exclusive of a dye of structure (I):

(I)

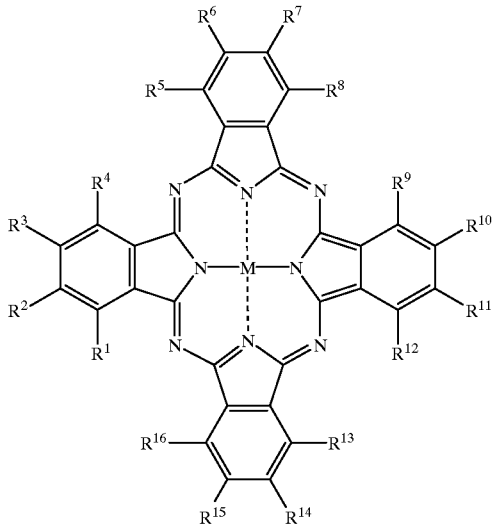

wherein M is a multi-valent metal atom; each of $R_1$, $R_4$, $R_5$, $R_8$, $R_9$, $R_{12}$, $R_{13}$, and $R_{16}$ independently represent a hydrogen atom, or a substituted or unsubstituted, branched or unbranched alkyl group; each of $R_2$, $R_3$, $R_6$, $R_7$, $R_{10}$, $R_{11}$, $R_{14}$and $R_{15}$ independently represent a hydrogen atom, a halogen atom, a substituted or unsubstituted, branched or unbranched alkyl group, a substituted or unsubstituted aryl group, a substituted or unsubstituted alkoxy group or a substituted or unsubstituted aryloxygroup; or one or more of the adjacent pairs $R_1$ and $R_2$, $R_2$ and $R_3$, $R_3$ and $R_4$, $R_5$ and $R_6$, $R_6$ and $R_7$, $R_7$ and $R_8$, $R_8$ and $R_9$, $R_9$ and $R_{10}$, $R_{10}$ and $R_{11}$, $R_{11}$ and $R_{12}$, $R_{13}$ and $R_{14}$, $R_{14}$ and $R_{15}$ and $R_{13}$ and $R_{16}$ taken together may represent the atoms necessary to form a substituted or unsubstituted aromatic or heteroaromatic ring.

9. Photothermographic recording material according to claim 7, wherein one of said at least two colorants incorporated into said support is represented by formula (II):

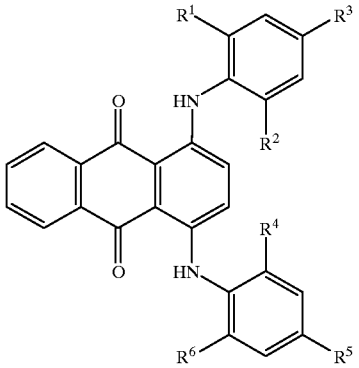

wherein $R^1$, $R^2$, $R^3$, $R^4$, $R^5$ and $R^6$ are independently each hydrogen or an alkyl group.

10. Photothermographic recording material according to claim 7, wherein said photosensitive silver halide is spectrally sensitized to infra-red wavelengths.

11. A photothermographic recording process comprising the steps of: (i) imagewise exposing a black and white monosheet photothermographic recording material having a spectrophotometrically determined maximum absorption for visible light between 570 and 650 m and comprising a support and a photo-addressable thermally developable element, said photo-addressable thermally developable element containing a substantially light-insensitive organic silver salt, an organic reducing agent therefor in thermal working relationship therewith, photosensitive silver halide in catalytic association with said substantially light-insensitive organic silver salt and a binder; (ii) bringing an outermost layer of said photothermographic recording material in proximity with a heat source; (iii) applying heat from the heat source to the photothermographic recording material under substantially water-free conditions while maintaining proximity to the heat source to produce an image; and (iv) removing the photothermographic recording material from the heat source, wherein said black and white monosheet photothermographic recording material contains at least two colorants with maximum absorptions at a wavelength between 450 nm and 700 nm; at least one of said at least two colorants is incorporated in said support, and the other of said at least two colorants is incorporated in said thermosensitive element, in a layer on the other side of said support to said thermosensitive layer or a combination thereof; and none of said at least two colorants has a maximum absorption at a wavelength within 30 nm of the wavelength at which maximum spectral sensitivity of said photothermographic recording material is observed.

* * * * *